US010309249B2

(12) United States Patent
Tezuka

(10) Patent No.: US 10,309,249 B2
(45) Date of Patent: Jun. 4, 2019

(54) CONTROL APPARATUS FOR A GAS-TURBINE AEROENGINE

(71) Applicant: HONDA MOTOR CO., LTD., Tokyo (JP)

(72) Inventor: Makoto Tezuka, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 938 days.

(21) Appl. No.: 14/689,301

(22) Filed: Apr. 17, 2015

(65) Prior Publication Data

US 2016/0305345 A1 Oct. 20, 2016

(51) Int. Cl.
*F01D 21/06* (2006.01)

(52) U.S. Cl.
CPC ..... *F01D 21/06* (2013.01); *F05D 2260/80* (2013.01)

(58) Field of Classification Search
CPC ..... F02C 9/00; F02C 9/20; F02C 9/26; F02C 9/28; F01D 17/00; F01D 17/02; F01D 17/04; F01D 17/06; F01D 17/08; F01D 17/085; F01D 21/00; F01D 21/02; F01D 21/04; F01D 21/06; F05D 2260/80; F05D 2270/02; F05D 2270/021; F05D 2270/022; F05D 2270/023
USPC ..... 60/773
See application file for complete search history.

(56) References Cited

U.S. PATENT DOCUMENTS 3,971,208 A * 7/1976 Schwent ..... F02C 9/32 60/226.1
6,748,744 B2 * 6/2004 Peplow ..... F02C 9/28 60/243
2007/0005219 A1 * 1/2007 Muramatsu ..... F02C 9/28 701/100

FOREIGN PATENT DOCUMENTS

JP 2006-009684 1/2006

* cited by examiner

*Primary Examiner* — Thai Ba Trieu
*Assistant Examiner* — Loren C Edwards
(74) *Attorney, Agent, or Firm* — Rankin, Hill & Clark LLP

(57) ABSTRACT

A control apparatus for a gas-turbine aeroengine having discriminator that discriminates normality of a low-pressure turbine rotational speed sensor adapted to detect the low-pressure turbine rotational speed and a high-pressure turbine rotational speed controller that establish a first value as an upper limit value of a high-pressure turbine rotational speed and controls the high-pressure turbine rotational speed based on the established upper limit value, and is configured to change the upper limit value to a second value lower than the first value when the low-pressure turbine rotational speed sensor is discriminated not to be normal, whereby engine output (thrust) determined by the low-pressure turbine rotational speed can be controlled to a desired value while restraining the high-pressure turbine rotational speed to not greater than the first value, and low-pressure turbine overspeed at the time of a mishap such as engine fan blade breakage can be reliably prevented.

10 Claims, 3 Drawing Sheets

CONTROL APPARATUS FOR A GAS-TURBINE AEROENGINE

BACKGROUND OF THE INVENTION

Field of the Invention

An embodiment of this invention relates to control apparatus for a gas-turbine aeroengine.

Description of the Related Art

A gas-turbine aeroengine is typically equipped with at least a high-pressure turbine rotated by injection of high-pressure gas produced upon ignition and combustion of an air-fuel mixture in a combustion chamber and with a low-pressure turbine located downstream of the high-pressure turbine to be rotated by low-pressure gas exiting the high-pressure turbine. Such a gas-turbine aeroengine is provided with sensors or detectors for detecting numerous operating parameters used to control the engine, including a low-pressure turbine rotational speed N1, a high-pressure turbine rotational speed N2, and an outlet pressure P3 of a high-pressure compressor connected to the high-pressure turbine.

As the control is disturbed by abnormalities arising in these sensors, each or a relatively important one of the sensors is preferably monitored for malfunctioning by estimating (calculating) the operating parameter based on the output(s) of the other sensor(s) and comparing the estimated operating parameter with the outputs of the sensor(s).

Therefore, as taught by Japanese Laid-Open Patent Application No. 2006-9684 (Patent Document 1), it has been proposed to use the relationship between the outputs of the high-pressure turbine rotational speed sensor and an intake air temperature sensor to calculate an estimated value of the low-pressure turbine rotational speed N1 as an operating parameter and to discriminate the normality of the low-pressure turbine rotational speed sensor by comparing the calculated operating parameter with the output of the low-pressure turbine rotational speed sensor.

SUMMARY OF THE INVENTION

The technique set forth in Patent Document 1 can calculate an estimated value of the low-pressure turbine rotational speed N1. However, when the low-pressure turbine rotational speed sensor fails in a situation where breakage of a fan blade in the engine or other such mishap has occurred, a risk of low-pressure turbine overspeed arises, making it essential to discriminate the normality of the low-pressure turbine rotational speed sensor and prevent low-pressure turbine overspeed.

Therefore, an object of this invention is to resolve the aforesaid issue by providing a control apparatus for a gas-turbine aeroengine which discriminates normality of a low-pressure turbine rotational speed sensor and prevents low-pressure turbine overspeed even when the sensor is abnormal.

In order to achieve the object, this invention provides in its first aspect an apparatus for controlling a gas-turbine aeroengine mounted on an aircraft and having at least a high-pressure turbine rotated by injection of high-pressure gas produced upon ignition and combustion of an air-fuel mixture in a combustion chamber, and a low-pressure turbine located downstream of the high-pressure turbine to be rotated by low-pressure gas exiting the high-pressure turbine, comprising: a low-pressure turbine rotational speed sensor adapted to detect a rotational speed of the low-pressure turbine; a high-pressure turbine rotational speed sensor adapted to detect a rotational speed of the high-pressure turbine; a low-pressure turbine rotational speed sensor normality discriminator that discriminates whether or not the low-pressure turbine rotational speed sensor is normal; and a controller that establishes a first value as an upper limit value of the rotational speed of the high-pressure turbine and controls the rotational speed of the high-pressure turbine based on the established upper limit value; wherein the upper limit value changer changes the upper limit value to a second value that is lower than the first value, when the low-pressure turbine rotational speed sensor normality discriminator discriminates that the low-pressure turbine rotational speed sensor is not normal.

In order to achieve the object, this invention provides in its second aspect a method for controlling a gas-turbine aeroengine mounted on an aircraft and having at least a high-pressure turbine rotated by injection of high-pressure gas produced upon ignition and combustion of an air-fuel mixture in a combustion chamber, a low-pressure turbine located downstream of the high-pressure turbine to be rotated by low-pressure gas exiting the high-pressure turbine, a low-pressure turbine rotational speed sensor adapted to detect a rotational speed of the low-pressure turbine; and a high-pressure turbine rotational speed sensor adapted to detect a rotational speed of the high-pressure turbine; comprising the steps of: discriminating whether or not the low-pressure turbine rotational speed sensor is normal; and establishing a first value as an upper limit value of the rotational speed of the high-pressure turbine and controlling the rotational speed of the high-pressure turbine based on the established upper limit value; wherein the step of controlling changes the upper limit value to a second value that is lower than the first value, when the step of low-pressure turbine rotational speed sensor normality discriminating discriminates that the low-pressure turbine rotational speed sensor is not normal.

BRIEF DESCRIPTION OF DRAWINGS

The above and other objects and advantages of the invention will be more apparent from the following description and drawings in which.

DESCRIPTION OF EMBODIMENT

An embodiment of a control apparatus for a gas-turbine aeroengine according to the present invention will now be explained with reference to the attached drawings.

Figure 1:
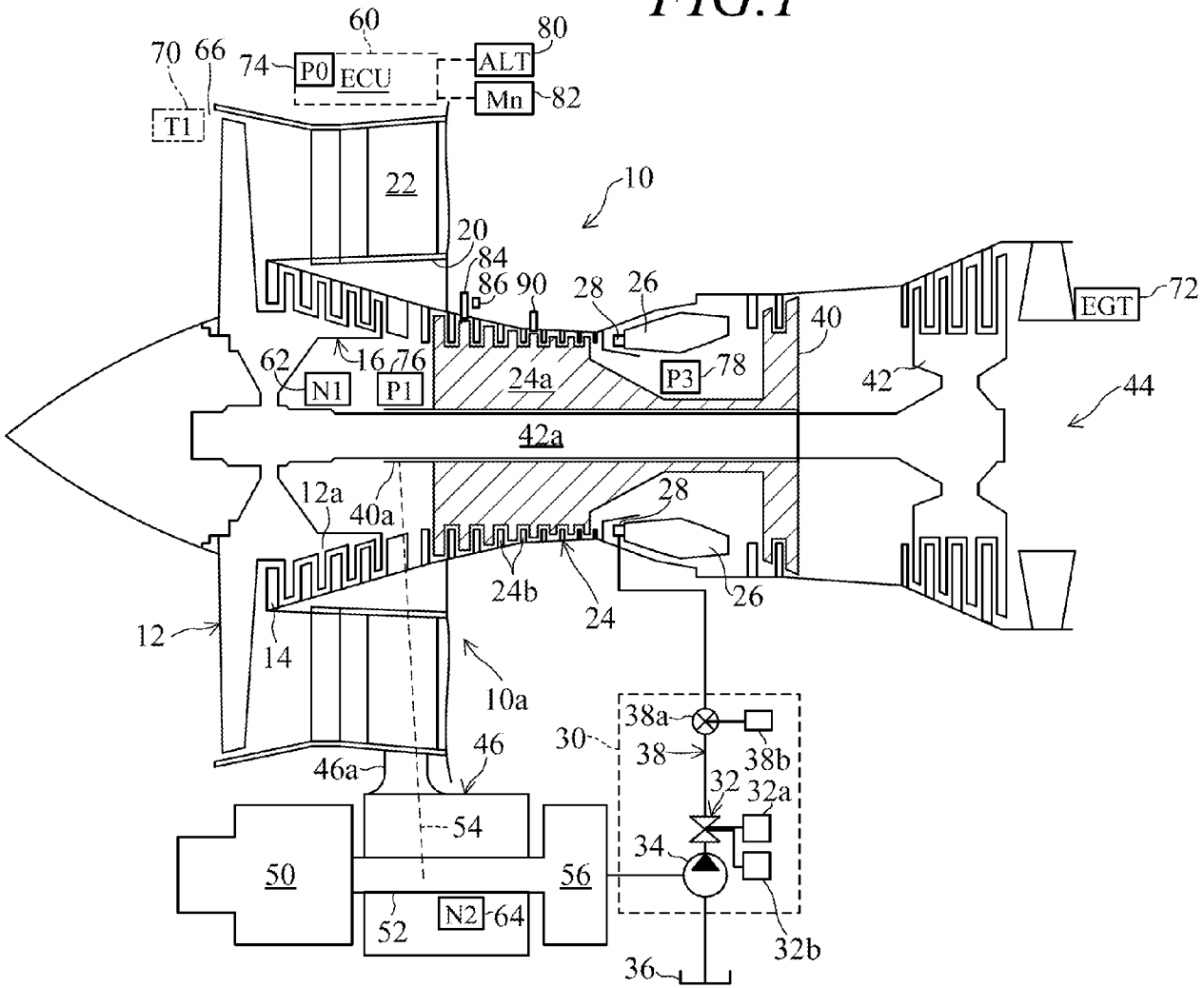
FIG. 1 is an overall schematic view of a control apparatus for a gas-turbine aeroengine.

FIG. 1 is an overall schematic view of the control apparatus for a gas-turbine aeroengine.

Four types of gas-turbine aeroengines are known: the turbojet engine, turbofan engine, turboprop engine and turboshaft engine. A two-shaft turbofan engine will be taken as an example in the following explanation.

In FIG. 1, reference numeral 10 designates the turbofan engine (gas turbine engine; hereinafter referred to as "engine"). Reference numeral 10*a* designates a main engine unit. Two of the engines 10 are installed, one on either side of an aircraft (whose airframe is not shown).

The engine 10 is equipped with a fan (fan blades) 12 that sucks in external air while rotating rapidly. A rotor 12*a* is formed integrally with the fan 12. The rotor 12*a* and a stator 14 facing it together form a low-pressure compressor 16 that compresses the sucked-in air and pumps it rearward.

A duct (bypass) 22 is formed in the vicinity of the fan 12 by a separator 20. Most of the air pulled in passes through the duct 22 to be jetted rearward of the engine without being burned at a later stage (in the core). The wind from the fan 12 produces a force of reaction that acts on the airframe (not shown) on which the engine 10 is mounted as a propulsive force (thrust). Most of the propulsion is produced by the air flow from the fan.

The air compressed by the low-pressure compressor 16 flows rearward to a high-pressure compressor 24 where it is further compressed by a rotor 24*a* and stator 24*b* and then flows rearward to a combustion chamber 26.

The combustion chamber 26 is equipped with a fuel nozzle 28 that is supplied with pressurized fuel metered by an FCU (fuel control unit) 30. The FCU 30 is equipped with a fuel metering valve (FMV) 32. Fuel pumped by a fuel pump 34 from a fuel tank 36 located at an appropriate part of the airframe is metered by the fuel metering valve 32 and supplied to the fuel nozzle 28 through a fuel supply line 38.

The fuel metering valve 32 is connected to a torque motor 32*a* to be opened/closed thereby. The position of the fuel metering valve 32 is detected by a nearby valve position sensor 32*b*. A fuel shutoff valve (SOV) 38*a* is interposed in the fuel supply line 38. The fuel shutoff valve 38*a* is connected to an electromagnetic solenoid 38*b* to be opened/closed thereby.

The fuel nozzle 28 sprays the fuel supplied through the fuel supply line 38.

The fuel sprayed from the fuel nozzle 28 and compressed air supplied from the high-pressure compressor 24 are mixed in the combustion chamber 26 and the air-fuel mixture is burned after being ignited at engine starting by an ignition unit (not shown) comprising an exciter and a sparkplug. Once the air-fuel mixture begins to burn, the air-fuel mixture composed of compressed air and fuel is continuously supplied and burned.

The hot high-pressure gas produced by the combustion is sent to a high-pressure turbine 40 to rotate it at high speed. The high-pressure turbine 40 is connected to the rotor 24*a* of the high-pressure compressor 24 through a high-pressure turbine shaft 40*a* to rotate the rotor 24*a*.

After driving the high-pressure turbine 40, the hot high-pressure gas is sent to a low-pressure turbine 42 to rotate it at relatively low speed. The low-pressure turbine 42 is connected to the rotor 12*a* of the low-pressure compressor 16 through a low-pressure turbine shaft 42*a* (in a dual concentric structure with the shaft 40*a*), so as to rotate the rotor 12*a* and fan 12. The gas having passed through the high-pressure turbine 40 is lower in pressure than gas jetted from the combustion chamber 26.

The exhaust gas exiting the low-pressure turbine 42 (turbine exhaust gas) is mixed with the fan exhaust air passing as is through the duct 22 and jetted together rearward of the engine 10 through a jet nozzle 44.

An accessory drive gearbox (hereinafter referred to as "gearbox") 46 is attached to the outer undersurface at the front end of the main engine unit 10*a* through a stay 46*a*. An integrated starter/generator (hereinafter called "starter") 50 is attached to the front of the gearbox 46. The FCU 30 is located at the rear of the gearbox 46.

At starting of the engine 10, the starter 50 rotates a shaft 52 whose rotation is transmitted through a drive shaft 54 (and a gear mechanism including a bevel gear etc. (not shown)) to the high-pressure turbine shaft 40*a* to generate compressed air. The generated compressed air is supplied to the combustion chamber 26, as mentioned above.

The rotation of the shaft 52 is also transmitted to a PMA (permanent magnet alternator) 56 and the (high-pressure) fuel pump 34, whereby, as explained above, the fuel pump 34 is driven to supply metered fuel to the fuel nozzle 28 so as to be mixed with compressed air and atomized. The resulting air-fuel mixture is ignited to start combustion.

When the engine 10 reaches self-sustaining operating speed, the rotation of the high-pressure turbine shaft 40*a* is transmitted back to the shaft 52 through the drive shaft 54 (and the gear mechanism including the bevel gear etc. (not shown)) to drive the fuel pump 34 and also drive the PMA 56 and starter 50.

As a result, the PMA 56 generates electricity and the starter 50 also generates electricity to be supplied to the airframe. Therefore, particularly when the electrical load on the airframe side increases, power generated by the starter 50 increases and rotational load on the high-pressure turbine shaft increases, thereby affecting the high-pressure turbine rotational speed, as will be explained later.

An ECU (Electronic Control Unit) 60 is installed at an upward location of the main engine unit 10*a*. The ECU 60 is equipped with a microcomputer comprising a CPU, ROM, RAM, I/O etc. (none of which are shown) and is housed in a container for mounting at the upward position.

An N1 sensor (rotational speed sensor) 62 is installed near the low-pressure turbine shaft 42*a* of the engine 10 and outputs a signal indicating the rotational speed of the low-pressure turbine (rotational speed of the low-pressure turbine shaft 42*a*) N1 (so as to detect the speed N1), and an N2 sensor (rotational speed sensor) 64 is installed near the shaft 52 and outputs a signal indicating the rotational speed of the high-pressure turbine (rotational speed of the high-pressure turbine shaft 40*a*) (so as to detect the speed N2).

A T1 sensor (temperature sensor) 70 installed near an air intake 66 at the front of the main engine unit 10*a* outputs a signal indicating the engine inlet temperature (ambient or intake temperature) T1 (so as to detect the temperature the temperature T1). An EGT sensor (exhaust gas temperature sensor) 72 installed at a suitable location downstream of the low-pressure turbine 42 outputs a signal indicating the exhaust gas temperature (low-pressure turbine outlet temperature) EGT (so as to detect the temperature EGT).

A P0 sensor (pressure sensor) 74 installed inside the container that houses the ECU 60 outputs a signal indicating atmospheric pressure P0 (so as to detect the pressure P0), and a P1 sensor (pressure sensor) 76 installed near the air intake 66 outputs a signal indicating engine inlet pressure (air intake pressure) P1 (so as to detect the pressure P1). In addition, a P3 sensor 78 installed downstream of the high-pressure compressor 24 outputs a signal indicating compressor outlet pressure (outlet pressure of the high-pressure compressor 24) P3 (so as to detect the pressure P3).

The outputs of the foregoing sensors indicating the operating condition of the engine 10 are sent to the ECU 60.

On the airframe side are installed a flight altitude sensor 80 that produces an output indicating the flight altitude ALT of the aircraft (so as to detect the flight altitude ALT) and a flight speed sensor 82 that produces an output indicating the flight speed Mn (Mach Number) of the aircraft (so as to detect the speed Mn). The outputs of these sensors are also sent to the ECU 60 comprising a computer on the airframe side.

The high-pressure compressor 24 is equipped with a BOV (Bleed Off Valve) 84 at a location of its front stage. During starting, low-speed operation and the like of the engine 10, some of the compressed air flowing through a compression passage of the high-pressure compressor 24 is bled off through the first BOV 84 and discharged into the duct 22.

The BOV 84 is opened and closed by an electromagnetic solenoid valve operated by commands from the ECU 60. A BOV position sensor 86 installed near the BOV 84 to produce and send to the ECU 60 a signal indicating the amount of air bled through the BOV 84 based on the position (opening angle) of the BOV 84 (so as to detect the bleed air amount).

In addition, the high-pressure compressor 24 is equipped with another BOV (Bleed Off Valve) 90 at a location downstream of the BOV 84, and some of the compressed air flowing through a compression passage of the high-pressure compressor 24 is bled off through the BOV 90 and sent to the cabin etc. on the airframe side for airframe cabin pressurization, air conditioning, wing de-icing, air sealing and other purposes. The BOV 90 is opened and closed by an electromagnetic solenoid valve in response to manual operation of a switch by a pilot seated in the cockpit of the airframe.

Further, the ECU 60 is responsive to the position of a thrust lever operated by the pilot for controlling the operation of the torque motor 32*a* to open/close the fuel metering valve 32 and for energizing/de-energizing the electromagnetic solenoid 38*b* to open/close the fuel shutoff valve 38*a* and control supply of fuel to the fuel nozzle 28.

Figure 2:
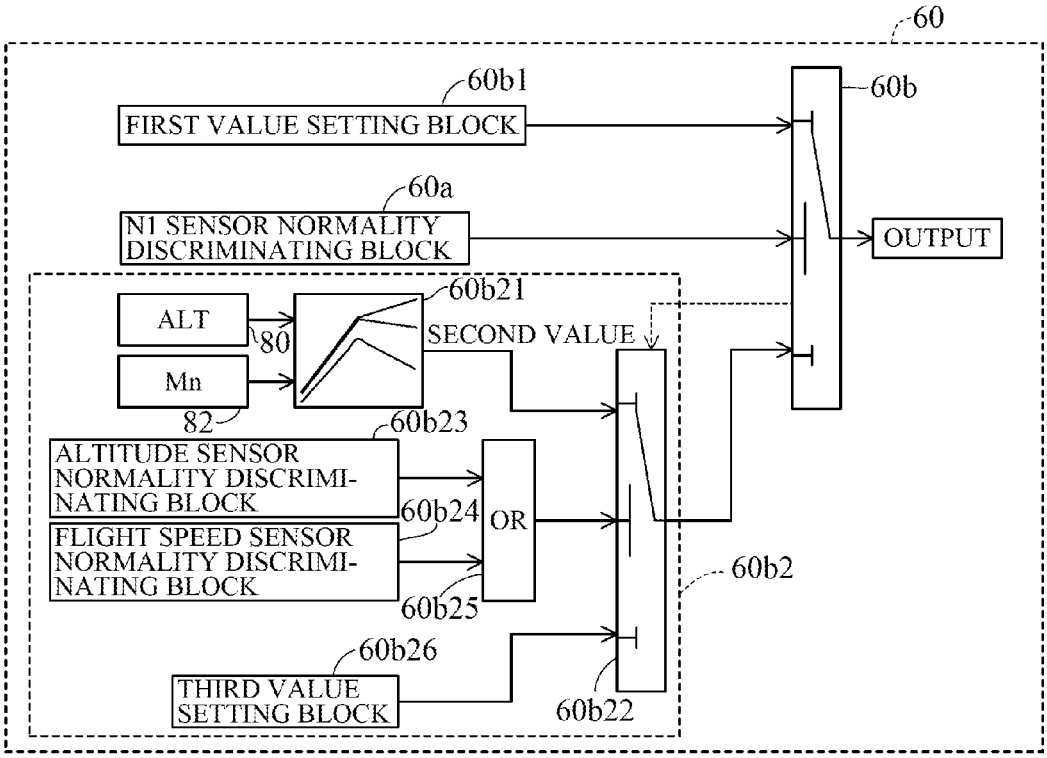
FIG. 2 is a flowchart for explaining operation of the apparatus.

FIG. 2 is a block diagram for functionally explaining such operation (processing) of the apparatus, more specifically the ECU 60. The illustrated processing is executed at predetermined time intervals.

Explaining this, the ECU 60 has an N1 sensor normality discriminating block (discriminator) 60*a* and a control block (controller) 60*b*.

The N1 sensor normality discriminating block 60*a* discriminates or determines whether or not the N1 sensor 62 is normal, more specifically the output of the N1 sensor 62 is normal by performing a range check, performing disconnection/short-circuiting checks and comparing outputs between channels (in other ECUs not shown), and also by comparison with estimated values obtained by the technique of Patent Document 1 and/or appropriately established reference values.

The control block 60*b* is connected with a first value setting block 60*b*1 that sets a first value as an upper limit value of the rotational speed N2 of the high-pressure turbine 40. Upon receiving the first value set by the value defining block 60*b*1 as input, the control block 60*b* establishes or defines the first value as the upper limit value of the rotational speed N2 of the high-pressure turbine 40 and controls the rotational speed N2 of the high-pressure turbine 40 based on the established first value such that the rotational speed N1 of the low-pressure turbine 42 is within a permissible rotational speed.

The control block 60*b* is further equipped with an upper limit value changing block (changer) 60*b*2. The upper limit value changing block 60*b*2 receives the outputs of the flight altitude sensor 80 and flight speed sensor 82 as inputs, retrieves characteristics (3D mapped data) 60*b*21 by the inputted values ALT and Mn to establish or define a second value, and outputs the second value to a selection circuit 60*b*22.

Figure 3:
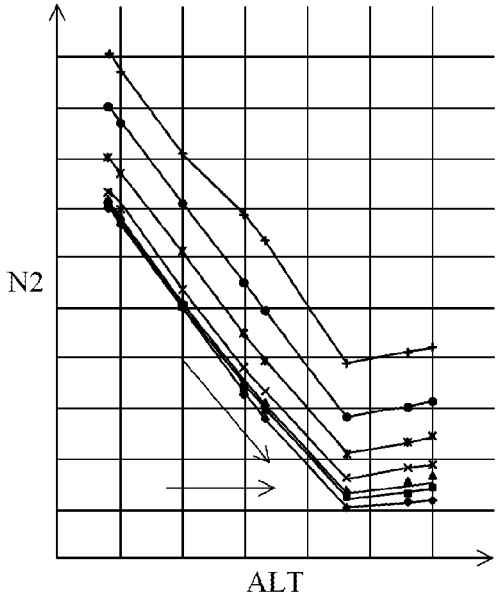
FIG. 3 is a graph showing an aspect of characteristics (shown in FIG. 2) expressing high-pressure turbine rotational speed relative to the flight altitude of the aircraft.
Figure 4:
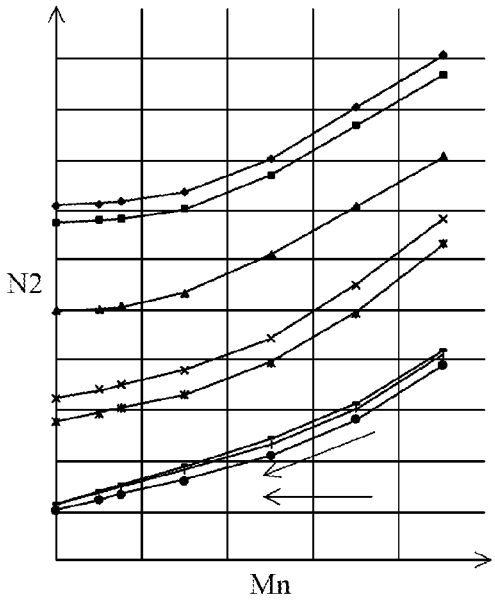
FIG. 4 is a graph similarly showing an aspect of the characteristics expressing high-pressure turbine rotational speed relative to the flight speed of the aircraft.

FIG. 3 is a graph showing an aspect of the characteristics 60*b*21 expressing high-pressure turbine rotational speed N2 (corresponding to the second value) relative to the flight altitude ALT, and FIG. 4 is a graph showing an aspect of the characteristics 60*b*21 expressing high-pressure turbine rotational speed N2 (also corresponding to the second value) relative to the flight speed Mn. Characteristic curves for a number of flight speeds Mn are shown in FIG. 3 and for a number of flight altitudes ALT in FIG. 4.

As shown in FIG. 3, the high-pressure turbine rotational speed N2, i.e., the second value is established or defined to decrease with increasing ALT (detected from the output of the flight altitude sensor 80) of the aircraft (in which the engine 10 is mounted).

Further, as shown in FIG. 4, the high-pressure turbine rotational speed N2, i.e., the second value is established or defined to decrease with decreasing flight speed Mn of the aircraft detected from the output of the flight speed sensor 82.

Returning to the explanation of FIG. 2, as illustrated, the upper limit value changing block 60*b*2 includes a flight altitude sensor normality discriminating block (discriminator) 60*b*23 that discriminates whether or not flight altitude sensor 80, more precisely its output is normal, and a flight speed sensor normality discriminating block (discriminator) 60*b*24 that discriminates whether or not the flight speed sensor 82, more precisely its output is normal.

When at least one of the flight altitude sensor normality discriminating block 60*b*23 or the flight speed sensor normality discriminating block 60*b*24 discriminates that the associated sensor is not normal (is abnormal), the output of the block 60*b*23 or 60*b*24 is sent through an OR circuit 60*b*25 to the selection circuit 60*b*22.

Further, the upper limit value changing block 60*b*2 is connected to a third value setting block 60*b*26 that sets a third value as the upper limit value of the rotational speed N2 of the high-pressure turbine 40, and the output of the third value setting block 60*b*26 is also sent to the selection circuit 60*b*22. The selection circuit 60*b*22 operates in response to commands from the control block 60*b*.

In the configuration shown in FIG. 2, when the N1 sensor normality discriminating block 60*a* discriminates that the N1 sensor 62 is not normal (is abnormal), the control block 60*b* operates the selection circuit 60*b*22 to input the second value, thereby changing the upper limit value to the second value that is lower than the first value.

Further, when the sensor associated with either the flight altitude sensor normality discriminating block 60*b*23 or the flight speed sensor normality discriminating block 60*b*24 is discriminated not to be normal (to be abnormal), the control block 60*b* operates the selection circuit 60*b*22 to input the third value set by the third value setting block 60*b*26, thereby establishing or defining the third value that is still lower than the second value as the upper limit value of the rotational speed N2 of the high-pressure turbine 40.

In the configuration shown in FIG. 2, the control block 60*b* thus calculates and outputs a control value of the turbine rotational speed N2 of the high-pressure turbine 40 based one of the established or defined first to third values.

As stated above, the embodiment is configured to have an apparatus (and method) for discriminating ignition in a gas-turbine aeroengine (10) mounted on an aircraft and having at least a high-pressure turbine (40) rotated by injection of high-pressure gas produced upon ignition and combustion of an air-fuel mixture in a combustion chamber (26), and a low-pressure turbine (42) located downstream of the high-pressure turbine to be rotated by low-pressure gas exiting the high-pressure turbine, comprising: a low-pressure turbine rotational speed sensor (N1 sensor 62) adapted to detect a rotational speed N1 of the low-pressure turbine 42; a high-pressure turbine rotational speed sensor (N2 sensor 64) adapted to detect a rotational speed N2 of the high-pressure turbine (40); a low-pressure turbine rotational speed sensor normality discriminator (ECU 60; 60*a*) that discriminates whether or not the low-pressure turbine rotational speed sensor (62) is normal; and a controller (ECU 60, 60*b*) that establishes a first value as an upper limit value of the rotational speed of the high-pressure turbine and controls the rotational speed N2 of the high-pressure turbine (40) based on the established upper limit value; wherein the controller has an upper limit value changer (upper limit value changing block 60*b*2) that changes the upper limit value to a second value that is lower than the first value, when the low-pressure turbine rotational speed sensor normality discriminator discriminates that the low-pressure turbine rotational speed sensor (62), more specifically its output is not normal.

Thus, the control apparatus for a gas-turbine aeroengine has the normality discriminator that discriminates normality of the low-pressure turbine rotational speed sensor 62 for detecting a low-pressure turbine rotational speed N1 and the controller establishes the first value as the upper limit value of the high-pressure turbine rotational speed N2 and controls the high-pressure turbine rotational speed N2 based on the established upper limit value, and is configured to change the upper limit value to the second value lower than the first value when the low-pressure turbine rotational speed sensor 62 is discriminated not to be normal, whereby, by suitably defining the first value, engine output (thrust) determined by the low-pressure turbine rotational speed N1 can be controlled to a desired value while restraining the high-pressure turbine rotational speed N2 to not greater than the first value, and whereby, by changing the second value to lower than the first value, low-pressure turbine overspeed at the time of a mishap such as blades of the fan 12 breakage can be reliably prevented.

The apparatus further including: a flight altitude sensor (80) adapted to detects flight altitude of the aircraft; and a flight speed sensor (82) adapted to detect a flight speed of the aircraft; and wherein the upper limit value changer establishes the second value based on outputs of the flight altitude sensor (80) and the flight speed sensor (82).

Thus, the apparatus includes flight altitude sensor 80 for detecting aircraft flight altitude ALT and flight speed sensor 82 for detecting flight speed Mn of the aircraft, and is configured to establish the second value based on the outputs of the flight altitude sensor 80 and flight speed sensor 82 for detecting aircraft flight altitude ALT and flight speed Mn, whereby, in addition to the aforesaid effects, by defining the second value based on the flight altitude ALT and the flight speed Mn, which are major operating parameters affecting the low-pressure turbine rotational speed N1 (and high-pressure turbine rotational speed N2) that determines the engine output, it is possible to suitably define the second value and minimize engine output decline under prevailing conditions.

In the apparatus, the upper limit value changer (60*b*2) establishes the second value such that the second value decreases with increasing flight altitude of the aircraft.

With this, the apparatus is configured to define the second value to decrease with increasing aircraft flight altitude ALT detected from the output of the flight altitude sensor 80, whereby, in addition to the aforesaid effects, engine output decline can be minimized.

In the apparatus, the upper limit value changer (60*b*2) establishes the second value such that the second value decreases with decreasing flight speed of the aircraft.

With this, the apparatus is configured to define the second value to decrease with decreasing aircraft flight speed Mn detected from the output of the flight speed sensor 82, whereby, in addition to the aforesaid effects, engine output decrease can be prevented to a minimum extent.

In the apparatus, the upper limit value changer (60*b*2) includes: a flight altitude sensor normality discriminator (discriminating block 60*b*23) that discriminates whether or not the flight altitude sensor (80) is normal; and a flight speed sensor normality discriminator (discriminating block 60*b*24) that discriminates whether or not the flight speed sensor (82) is normal; and wherein the upper limit value changer (60*b*2) changes the upper limit value to a third value that is lower than the second value, when at least one of the flight altitude sensor normality discriminator and the flight speed sensor normality discriminator discriminates that at least one of the flight altitude sensor (80) and the flight speed sensor (82) is not normal.

Thus, the apparatus is configured to includes the normality discriminator that discriminates normality of the flight altitude sensor 80 and flight speed sensor 82, and is configured to change the upper limit value to the third value lower than the second value when that either or both of the flight altitude sensor and the flight speed sensor are not normal, whereby, in addition to the aforesaid effects, by delaying substantial change of the upper limit value until this stage, a sharp decline in engine output (thrust) can be delayed to this stage, and by suitably defining the third value, the low-pressure turbine overspeed can be reliably prevented even when the flight altitude sensor 80 or the flight speed sensor is not in a normal state.

While the invention has thus been shown and described with reference to a specific embodiment, it should be noted that the invention is in no way limited to the details of the described arrangements; changes and modifications may be made without departing from the scope of the appended claims.

What is claimed is:

1. An apparatus for controlling a gas-turbine aeroengine mounted on an aircraft and having at least a high-pressure turbine rotated by injection of high-pressure gas produced upon ignition and combustion of an air-fuel mixture in a combustion chamber, and a low-pressure turbine located downstream of the high-pressure turbine to be rotated by low-pressure gas exiting the high-pressure turbine, comprising:

a low-pressure turbine rotational speed sensor adapted to detect a rotational speed of the low-pressure turbine (N1);

a high-pressure turbine rotational speed sensor adapted to detect a rotational speed of the high-pressure turbine (N2);

a low-pressure turbine rotational speed sensor normality discriminator that compares an estimated operating parameter of the rotational speed of the low-pressure turbine with a detected value of the rotational speed of the low-pressure turbine to generate a comparison result and discriminates whether or not the low-pressure turbine rotational speed sensor is operating abnormally by determining if the detected value of the rotational speed of the low-pressure turbine exceeds the estimated operating parameter of the rotational speed of the low-pressure turbine; and a controller that establishes a first value as an upper limit value of the rotational speed of the high-pressure turbine (N2) and controls the rotational speed of the high-pressure turbine based on the established upper limit value;

wherein the controller has an upper limit value changer that changes the upper limit value to a second value that is lower than the first value, when the low-pressure turbine rotational speed sensor normality discriminator discriminates that the low-pressure turbine rotational speed sensor is operating abnormally based on the comparison result, and the controller controls rotational speed of the high-pressure turbine based on the second value.

2. The apparatus according to claim 1, further including:

a flight altitude sensor adapted to detect a flight altitude of the aircraft (ALT); and a flight speed sensor adapted to detect a flight speed of the aircraft (Mn); and wherein the upper limit value changer establishes the second value based on outputs of the flight altitude sensor and the flight speed sensor.

3. The apparatus according to claim 2, wherein the upper limit value changer establishes the second value such that the second value decreases with increasing flight altitude of the aircraft (ALT).

4. The apparatus according to claim 2, wherein the upper limit value changer establishes the second value such that the second value decreases with decreasing flight speed of the aircraft (Mn).

5. The apparatus according to claim 2, wherein the upper limit value changer includes:

a flight altitude sensor normality discriminator that compares an estimated operating parameter of the flight altitude with a detected flight altitude and discriminates whether or not the flight altitude sensor is operating abnormally by determining if the detected flight altitude exceeds the estimated operating parameter of the flight altitude; and a flight speed sensor normality discriminator that compares an estimated operating parameter of the flight speed with a detected flight speed and discriminates whether or not the flight speed sensor is operating abnormally determining if the detected flight speed exceeds the estimated operating parameter of the flight speed; and wherein the controller has an upper limit value changer that changes the upper limit value to a third value that is lower than the second value, when at least one of the flight altitude sensor normality discriminator and the flight speed sensor normality discriminator discriminates that at least one of the flight altitude sensor and the flight speed sensor is operating abnormally based on the respective comparison result.

6. A method using the apparatus of claim 1 for controlling a gas-turbine aeroengine mounted on an aircraft and having at least a high-pressure turbine rotated by injection of high-pressure gas produced upon ignition and combustion of an air-fuel mixture in a combustion chamber, a low-pressure turbine located downstream of the high-pressure turbine to be rotated by low-pressure gas exiting the high-pressure turbine, a low-pressure turbine rotational speed sensor adapted to detect a rotational speed of the low-pressure turbine (N1); and a high-pressure turbine rotational speed sensor adapted to detect a rotational speed of the high-pressure turbine (N2); comprising the steps of:

discriminating whether or not the low-pressure turbine rotational speed sensor is normal; and establishing a first value as an upper limit value of the rotational speed of the high-pressure turbine (N2) and controlling the rotational speed of the high-pressure turbine based on the established upper limit value;

wherein the step of controlling changes the upper limit value to a second value that is lower than the first value, when the step of low-pressure turbine rotational speed sensor normality discriminating discriminates that the low-pressure turbine rotational speed sensor is not normal.

7. The method according to claim 6, further including:

a flight altitude sensor adapted to detects a flight altitude of the aircraft (ALT); and a flight speed sensor adapted to detect a flight speed of the aircraft (Mn); and wherein the step of controlling includes step of upper limit value changing that establishes the second value based on outputs of the flight altitude sensor and the flight speed sensor.

8. The method according to claim 7, wherein the step of upper limit value changing establishes the second value such that the second value decreases with increasing flight altitude of the aircraft (ALT).

9. The method according to claim 7, wherein the step of upper limit value changing establishes the second value such that the second value decreases with decreasing flight speed of the aircraft (Mn).

10. The method according to claim 7, wherein the step of upper limit value changing includes the steps of:

discriminating whether or not the flight altitude sensor is normal; and discriminating whether or not the flight speed sensor is normal; and wherein the step of controlling changes the upper limit value to a third value that is lower than the second value, when at least one of the step of flight altitude sensor normality discriminating and the flight speed sensor normality discriminating discriminates that at least one of the flight altitude sensor and the flight speed sensor is not normal.

* * * * *